US005505469A

United States Patent [19]

Zorzi et al.

[11] Patent Number: 5,505,469

[45] Date of Patent: Apr. 9, 1996

[54] BRAKING DEVICE PARTICULARLY FOR SKATES

[75] Inventors: Claudio Zorzi, Paderno Di Ponzano Veneto; Peter Edauw, S. Zenone Degli Ezzelini; Luca Marconato, Padernello Di Paese, all of Italy

[73] Assignee: Nordica S.p.A., Montebelluna, Italy

[21] Appl. No.: 158,113

[22] Filed: Nov. 24, 1993

[30] Foreign Application Priority Data

Nov. 30, 1992 [IT] Italy ..... TY92A0149
Nov. 30, 1992 [IT] Italy ..... TY92A0151

[51] Int. Cl.[6] ..... A63C 17/14

[52] U.S. Cl. ..... 280/11.2; 280/11.22

[58] Field of Search ..... 280/11.2, 11.22, 280/11.23, 11.27, 11.28, 87.041, 87.042; 188/5, 6, 7

[56] References Cited

U.S. PATENT DOCUMENTS

| | | | |
|---|---|---|---|
| 920,848 | 5/1909 | Eubank | 280/11.2 |
| 926,646 | 6/1909 | Eubank | 280/11.2 |
| 979,169 | 12/1910 | Kennedy | 280/11.2 |
| 1,402,010 | 1/1922 | Ormiston | 280/11.2 |
| 1,445,048 | 2/1923 | Spross | 280/11.2 |
| 1,497,224 | 6/1924 | Ormiston | 280/11.2 |
| 1,687,739 | 10/1928 | Slusher | 280/11.2 |
| 2,179,592 | 11/1939 | Goettie | 280/11.2 |
| 3,767,220 | 10/1973 | Peterson | 280/11.2 |
| 4,033,596 | 7/1977 | Andorsen et al. | 280/11.2 |
| 4,275,895 | 6/1981 | Edwards | 280/11.2 |
| 4,300,781 | 11/1981 | Riggs | 280/11.2 |
| 4,943,072 | 7/1990 | Henig | 280/11.2 |
| 5,052,701 | 10/1991 | Olson | 280/11.2 |
| 5,088,748 | 2/1992 | Koselka et al. | 280/11.2 |
| 5,211,409 | 5/1993 | Mitchell et al. | 280/11.2 |
| 5,232,231 | 8/1993 | Carlsmith | 280/11.2 |
| 5,253,882 | 10/1993 | Mitchell | 280/11.2 |
| 5,374,070 | 12/1994 | Pellegrini et al. | 280/11.2 |
| 5,388,844 | 2/1995 | Pellegrini et al. | 280/11.2 |
| 5,397,137 | 3/1995 | Pellegrini et al. | 280/11.2 |

FOREIGN PATENT DOCUMENTS

| | | |
|---|---|---|
| 0567948 | 11/1993 | European Pat. Off. . |
| 0243560 | 12/1986 | United Kingdom . |
| 8903712 | 5/1989 | WIPO . |

*Primary Examiner*—Richard M. Camby
*Attorney, Agent, or Firm*—Hale and Dorr

[57] ABSTRACT

Braking device, particularly usable for skates including a shoe composed of a quarter which is articulated to a shell which is in turn associated with a frame for supporting wheels. The device includes at least one cable which connects the quarter to a braking element, so as to allow to obtain the braking action when the quarter is tilted.

24 Claims, 4 Drawing Sheets

BRAKING DEVICE PARTICULARLY FOR SKATES

BACKGROUND OF THE INVENTION

The present invention relates to a braking device particularly usable for skates including a shoe composed of a quarter articulated to a shell which is in turn associated with a frame for supporting one or more wheels.

In conventional roller skates, whether constituted by a shoe associated with a support for two pairs of mutually parallel wheels or by a shoe associated with a supporting frame for one or more aligned wheels, there is currently the problem of braking the wheels in order to adjust the speed of the skate.

It is known to use adapted pads or blocks, usually made of rubber, which are arranged at the toe or heel region of the shoe; when the user tilts the shoe forwards or backwards, the free end of the pads or blocks interacts with the ground and braking is thus achieved.

However, the operation of conventional brakes is not satisfactory because it requires the user to rotate the shoe, and thus the frame associated therewith, at the toe or at the heel, and this can cause the loss of balance with consequent fall.

U.S. Pat. No. 1,402,010 discloses a roller skate provided with a band which can be secured on the user's leg above the malleolar region and to which a rod is connected.

Said rod surrounds the leg to the rear and is then curved so as to laterally affect the leg until it is associated, at its ends, in the malleolar region, with a lever system which is articulated to a structure protruding from the wheel supporting frame.

The lever system protrudes to the rear of the frame and is connected to a plate which is shaped approximately complementarily to the curvature of part of an underlying facing wheel.

This solution is not free from drawbacks: first of all, a relative movement is produced between the band and the leg throughout sports practice, and this does not make its use comfortable due to the continuous rubbing of the band on the leg.

Furthermore, the plate is activated every time the user bends his leg backwards beyond a given angle, with no actual and easy possibility of varying this condition.

Furthermore, since the shape of the leg is different for each user, for the same rod length there is a different braking action at different rotation angles.

Furthermore, the rod rests and presses on the malleolar region, and this can cause discomfort or can cause accidental impacts.

Finally, the wheel wears out considerably.

U.S. Pat. No. 4,275,895 provides a partial solution to this drawback. This patent discloses a brake for skates provided with two pairs of mutually parallel wheels which acts at the rear wheels.

The brake is constituted by a flap which is associated with the shoe in a rearward region and with which a plate is associated in a rearward position. The plate is pivoted at the supporting frame of the shoe.

The plate has, at its free end, a transverse element on which a pair of C-shaped elements is formed at the lateral ends; following a backward rotation imparted to the flap, the C-shaped elements interact with the rear wheels facing them, in that they interact with the rolling surface of the wheels.

However, even this solution has drawbacks: it is in fact structurally complicated and therefore difficult to industrialize. It also entails the presence of adapted springs suitable to allow the flap to resume the position in which the pair of C-shaped elements does not interact with the wheels, thus further increasing structural complexity.

Furthermore, the structural configuration of the brake causes the pair of C-shaped elements to interact with the wheel even upon a minimal backward rotation imparted to the flap and therefore even for involuntary movements, and this creates unwanted braking actions and thus possible loss of balance or lack of coordination.

Finally, the interaction of the C-shaped element at the rolling surface of the wheels leads to rapid wear of the wheels and therefore to non-optimum rolling which necessarily entails continuous replacement of the wheels.

U.S. Pat. No. 4,300,781 discloses a braking device for skates which comprise pairs of mutually parallel wheels.

The brake is constituted by a plate which is pivoted transversely at the rear end of the frame for supporting a shoe. Blocks are associated with the ends of the plate and face the rolling surface of the pair of rear wheels.

The brake is activated by using a cable which is suitable to rotate the plate in contrast with a spring associated with the support for the pair of front wheels, so as to move the blocks into contact with the rolling surface of the pair of rear wheels.

The cable can be activated by means of rings or handles associated with a band which can be arranged on the legs of the user by virtue of the presence of temporary connection means.

However, this solution has considerable drawbacks: first of all, activation of the brake can lead to possible loss of balance because the user does not assume, with his body, a position suitable to control the sudden speed reduction; brake activation in fact involves only the skater's hand.

Furthermore, since the sport can be practiced while wearing trousers, when the rings are pulled the band may slip along the trousers or make them slide along the leg, hindering the braking action.

Furthermore, the loose cable is a hindrance to the skater and could accidentally catch during skating, especially since coordination of the arm-legs movement rhythmically moves the legs laterally outwards.

SUMMARY OF THE INVENTION

The aim of the present invention is therefore to eliminate the drawbacks described above in conventional skates by providing a braking device for skates which is structurally very simple and easy to industrialize.

Within the scope of the above aim, an object is to provide a braking device which can be activated by the user in case of actual need and not accidentally.

Another important object is to provide a braking device which can be activated rapidly, easily and safely by the user without forcing the user to perform movements, for example with his hands, which would compromise his/her balance or coordination.

Another important object is to provide a braking device which considerably reduces the wear of the rolling surface of the wheels.

Another important object is to obtain a device which associates with the preceding characteristics that of being reliable and safe in use, has low manufacturing costs and can also be applied to conventional skates.

This aim, these objects and others which will become apparent hereinafter are achieved by braking device, particularly for skates, comprising a shoe composed of a quarter which is articulated to a shell associated with a frame for supporting a set of wheels, characterized in that it comprises at least one traction element which connects said quarter to a braking element.

BRIEF DESCRIPTION OF THE DRAWINGS

Further characteristics and advantages of the present invention will become apparent from the detailed description of a particular embodiment, illustrated only by way of nonlimitative example in the accompanying drawings, wherein.

DESCRIPTION OF THE PREFERRED EMBODIMENTS

Figure 1:
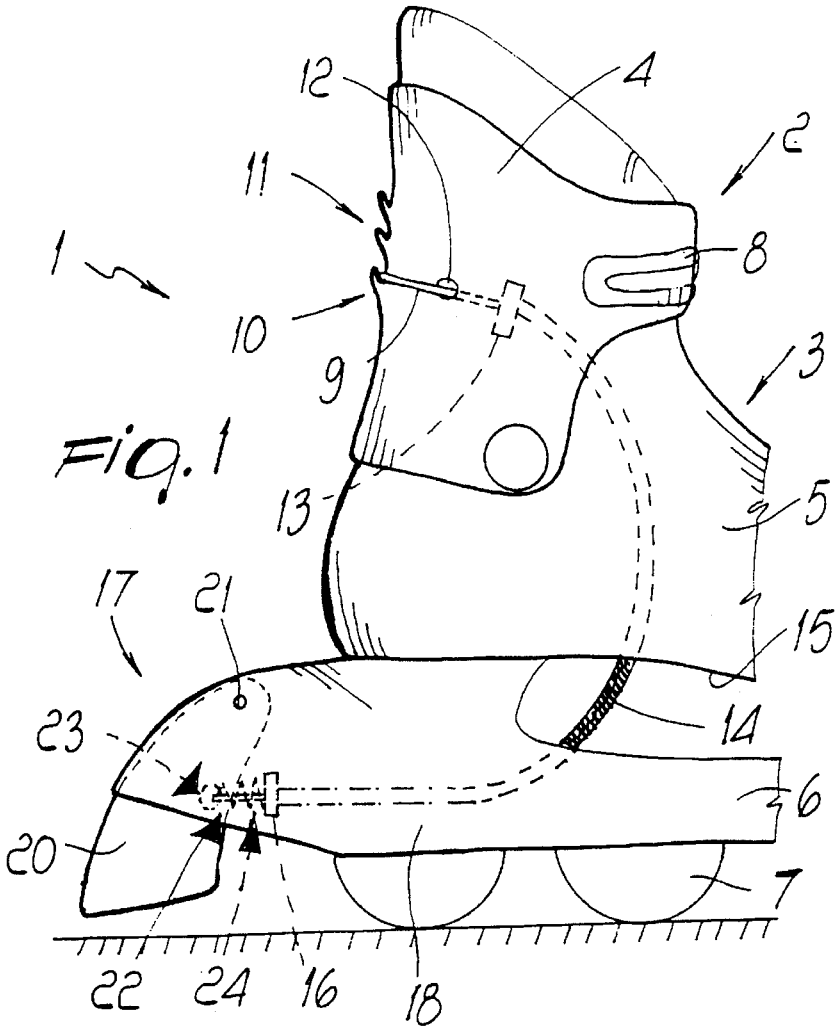
FIG. 1 is a side partial view of a skate having a braking device according to the invention.

With reference to FIG. 1, the reference numeral 1 designates the braking device, which is particularly usable for a skate, designated by the reference numeral 2.

The skate comprises a shoe 3 which is composed of a quarter 4 which surrounds the rear lateral region of the user's leg and is articulated to a shell 5 with which a frame 6 is associated in a lower region. The frame 6 has a cross-section shaped like an inverted U and supports one or more wheels which are designated by the reference numeral 7 and may be mutually aligned.

Conventional levers 8 may be applied for securing the quarter 4 and the shell 5.

The braking device comprises at least one traction element, generally designated by the reference numeral 9, which is preferably constituted by a cable, a first portion 10 whereof surrounds externally around the quarter 4 to the rear and is associated therewith at an adapted engagement means 11 such as a rack or a toothed region arranged longitudinally and to the rear of said quarter 4.

The cable is guided inside the shoe 3 by virtue of the presence of an adapted pair of holes 12 formed laterally with respect to the quarter 4. A first pair of stop elements 13 for a pair of cable guiding sheaths 14 is associated inside the quarter. The sheaths protrude below the sole 15 of the shell 5 and are locked, by means of a second pair of stop elements 16, inside the wings 18 of the frame 6.

The braking element 17 is composed of a brake which is constituted by a block 20 which is articulated transversely, by means of a pivot 21, to the frame 6 above the region where the sheath 14 is locked.

The cable has a second portion 22 which protrudes from the sheaths and passes within an adapted seat 23 which is formed transversely with respect to the block 20. A pair of springs 24 is also interposed coaxially to the cable between the seat 23 and the second pair of stop elements 16.

The springs allow the elastic return of the block to the original positions once the backward rotation of said quarter has ended.

The use of the braking device is in fact as follows: by virtue of the connection of the block 17 to the quarter 4 by means of the traction element 9, a backward rotation imparted by the user to the quarter 4 is followed by a traction imparted to the cable, which makes the block rotate counterclockwise with respect to the pivot 21, so as to interact with the ground.

This interaction occurs only for a preset rotation imparted to the quarter 4 which, by virtue of the position which can be given to the first portion of the traction element with respect to the rack, can thus be selected by the user.

This is done to allow the interaction of the block 17 with the ground 12 only when a given angle of backward rotation of the quarter 4 is exceeded, in order to avoid accidental braking actions.

The selection for the position of the first portion 10 of the traction element at the engagement means 11 thus allows both to compensate any wear of the block and to vary the extent of the inclination of the quarter before the block interacts with the ground.

Once the user has resumed the skating position, the spring allows the block to return to its initial position and thus rise from the ground.

It has been observed that the invention has achieved the intended aim and objects, a braking device having been obtained which can be activated by the user at a presettable angle of backward rotation of the quarter, and this can be achieved by giving the desired length to the traction element and/or by varying the position thereof with respect to the quarter 4.

Furthermore, both activation and deactivation of the braking element can be achieved in a very simple manner, allowing the user to assume a position suitable to control the braking action and thus maintaining the optimum balance condition and coordination in arm-legs movements.

The invention is furthermore structurally simple and easy to industrialize, and can also be easily applied to conventional skates.

The braking device according to the invention is naturally susceptible to numerous modifications and variations, all of which are within the scope of the same inventive concept.

Figure 2:
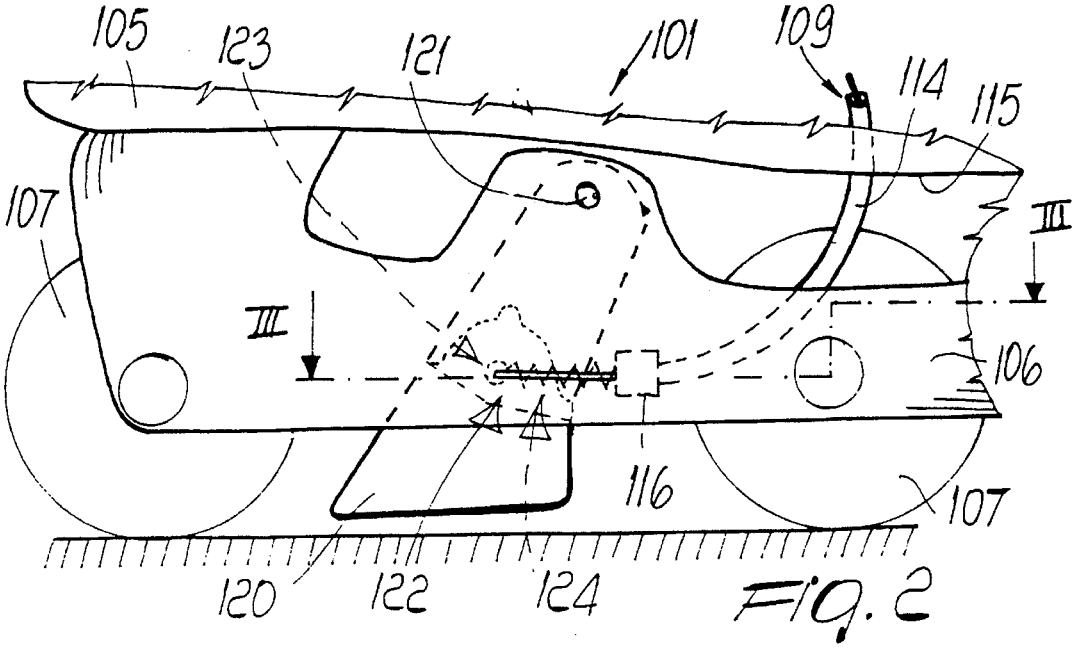
FIG. 2 is a side view of a braking device according to a second embodiment of the invention.

Thus, for example, FIG. 2 illustrates a second embodiment of the braking device 101 wherein the traction element 109 is again constituted by a cable which is guided within a pair of sheaths 114 which protrude below the sole 115 of the shell 105 and are locked at a second pair of stop elements 116 which are associated at the lateral wings of the frame 106.

The traction element 109 also has a second portion 122 which protrudes from the sheaths and passes within an adapted seat 123 formed transversely with respect to the block 120, which is interposed between two mutually adjacent wheels 107 in the interspace between the wings of the frame 106 and is pivoted transversely to said wings by means of a pivot 121.

A pair of springs 124 is arranged coaxially to the cable between the seat 123 and the second pair of stop elements 116.

As regards connection to the quarter, it may occur by virtue of the means shown in the previous embodiment.

The advantage afforded by the second embodiment is that the skate is longitudinally more compact, although all the other previously mentioned advantages are maintained.

Figure 4:
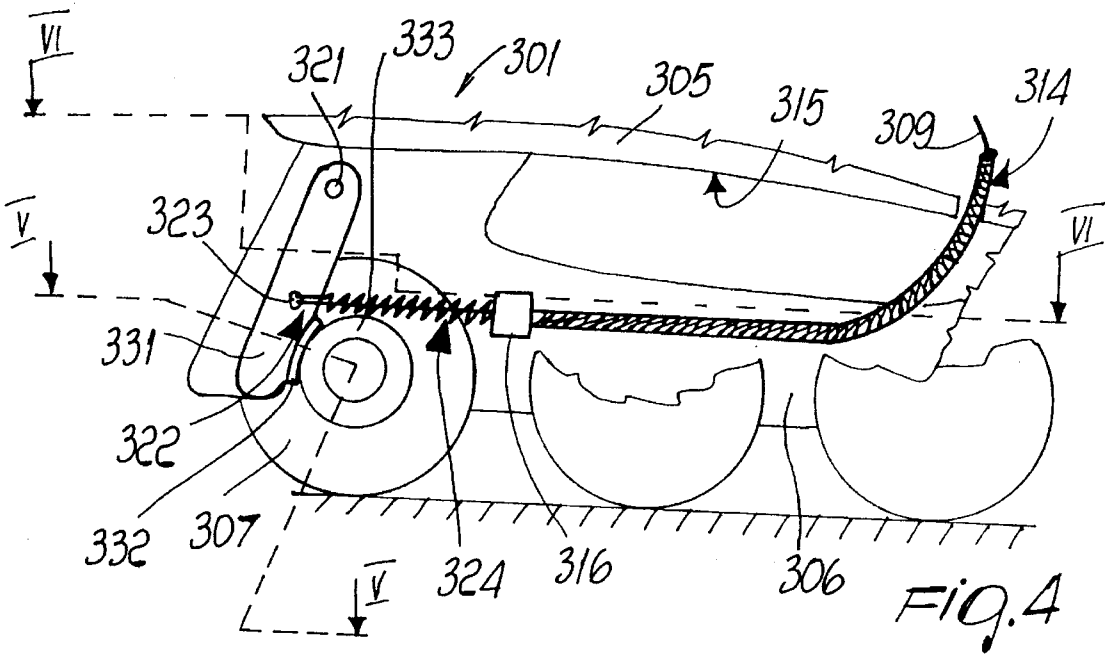
FIG. 4 is a view similar to that of FIG. 2 of a third embodiment of the invention.
Figure 3:
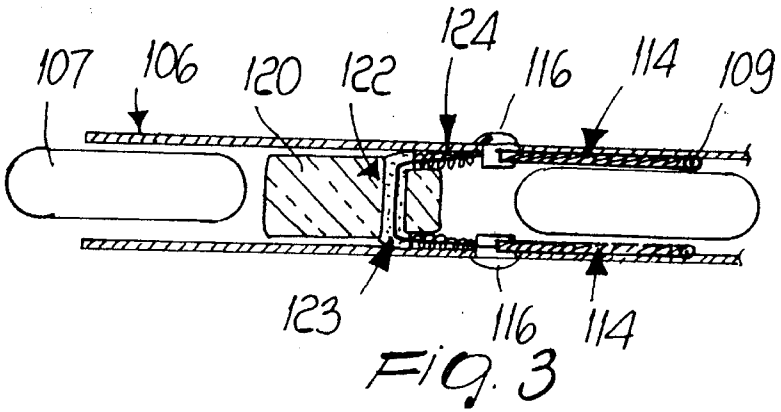
FIG. 3 is a sectional view, taken along the plane III—III of FIG. 2.
Figure 6:
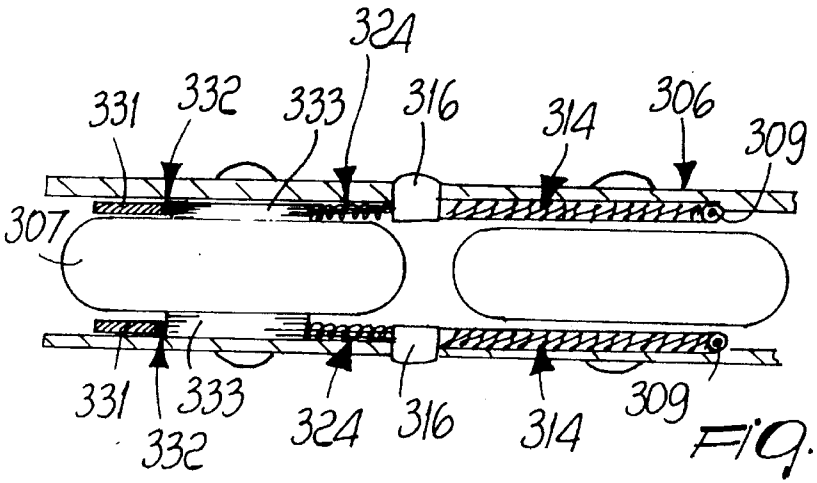
FIG. 6 is a sectional view, taken along the plane VI— VI of FIG. 4.
Figure 5:
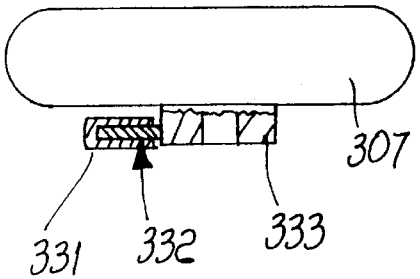
FIG. 5 is a sectional view, taken along the plane V—V of FIG. 4.

FIGS. 4 and 5 illustrate a third embodiment for a braking device 301, wherein the traction element 309 is again constituted by a cable which interacts with the quarter, as in the first embodiment, and is guided within an adapted pair of sheaths 314 which protrude below the sole 315 of the shell 305 and interact with a second pair of stop elements 316 which are associated laterally at the wings of the frame 306.

The traction element also has a second portion 322 which is associated with an adapted seat 323 formed transversely with respect to at least one lever, preferably a pair of levers 331 which have one end freely pivoted, by means of a pivot 321, to the wings of the frame 306 below the sole 315, whereas a braking pad 332 made of high-strength material is advantageously associated with the other end and interacts directly with the facing hub 333 of a wheel 307.

The seat 323 is formed in the interspace between the pivot 321 and the braking pad 332, so that traction applied to the cable is followed by direct interaction of the braking pad 332 with the hub 333.

In this solution, too, a spring 324 is arranged coaxially to the cable and is in turn interposed between the seat 323 and the second pair of stop elements 316.

This solution, too, allows to achieve the intended aim and objects.

Figure 7:
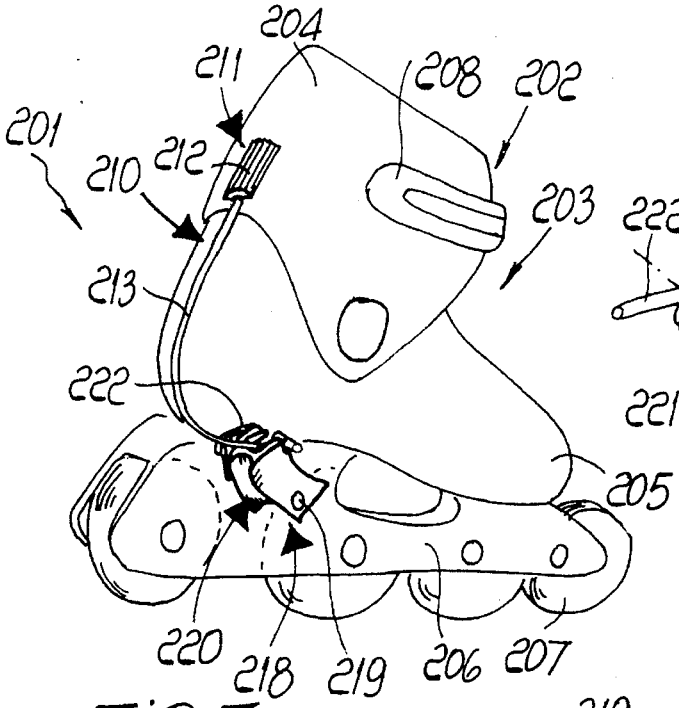
FIG. 7 is a rear perspective view of a skate having a braking device according to a fourth aspect of the invention.
Figure 8:
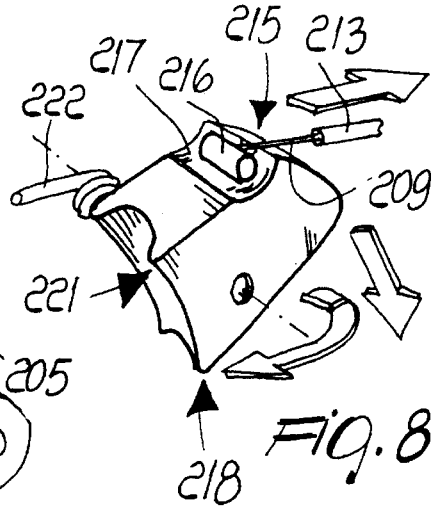
FIG. 8 is a detail exploded view of the braking device of FIG. 7.
Figure 9:
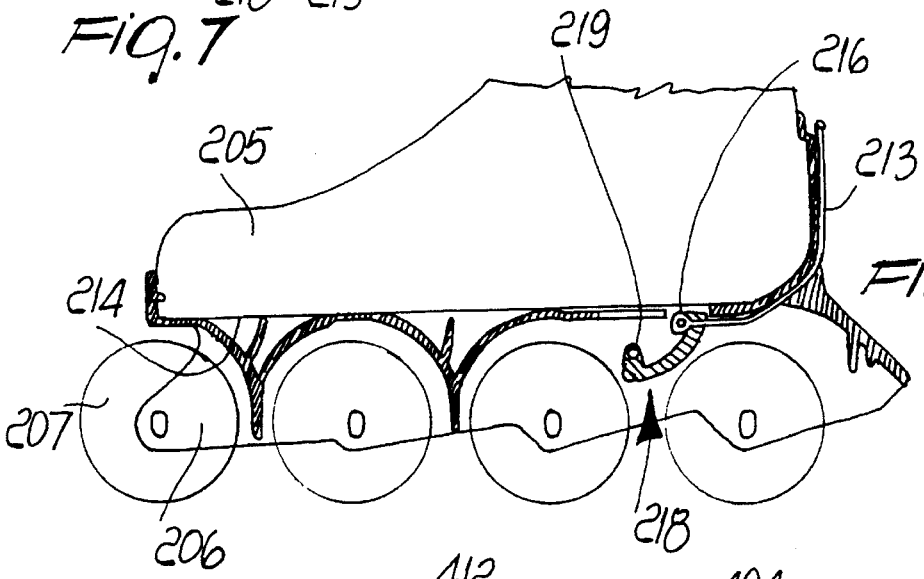
FIG. 9 is a sectional side partial view of the skate of FIGS. 7 and 8.

With reference to FIGS. 7–9, the reference numeral 201 designates a braking device according to a fourth aspect of the invention, applied to a skate 202.

The skate 202 comprises a shoe 203 which is composed of a quarter 204 which surrounds the rear lateral region of the user's leg and is articulated to a shell 205 with which a frame 206 is associated in a lower region. The frame 206 has a cross-section shaped like an inverted U and supports one or more wheels which are designated by the reference numeral 207 and may be mutually aligned.

Conventional levers 208 may be applied for the securing of the quarter 204 and of the shell 205.

The braking device comprises at least one traction element, generally designated by the reference numeral 209, which is preferably constituted by a cable, a first end 210 whereof is arranged to the rear of the quarter 204 and is associated with a means 211 for taking up the working length of the cable. The means 211 is associated with the quarter 204 in a rearward region.

The means for taking up the working length of the cable can be constituted, for example, by a cylindrical knob 212 which is arranged longitudinally with respect to the quarter 204 and has a threaded axial seat for a complementarily threaded stop element which is associated with the first end 210 of the cable 209, which can thus be taken up or released by means of a rotation imparted to said knob 212.

The cable is slidingly associated with an adapted sheath 213 which runs in a rearward region, internally or externally, with respect to the quarter 204 and to the shell 205 until it arrives below the sole 214.

The second end 215 of the cable has a stop element 216 which is accommodated at an adapted first seat 217 formed at a braking element 218 which is pivoted, by means of a pivot 219, between the wings of the frame 206 in a region above the space between two mutually adjacent wheels 207.

The braking element 218 has, in a transverse cross-section, an arched shape with concavities directed toward the wheels 207. The first seat 217 is formed on a plane of arrangement which lies above the plane of arrangement of the pivot 219 and in a more rearward position, so that traction applied by the cable is matched by the approach of an adapted first slot 220, formed to the rear of said braking element 218, toward the rolling surface of one of the wheels.

Advantageously, in front of the braking element 218 there is a second slot 221 which is such as to allow non-interaction with the adjacent wheel 207.

The braking element 218 is kept in neutral position, so that the first and second slots 220 and 221 do not interact with the wheels, by means of an adapted first spring 222.

Activation of the braking element occurs, in this embodiment, following a forward tilting of the quarter 204 beyond a given rotation angle which can be selected for example by virtue of the means 211 for taking up the working length of the traction element. By virtue of the connection of the stop element 216 to the braking element 218, a backward rotation imparted by the user to said quarter 204 is in fact followed by a traction imparted to the cable which rotates the braking element so that the first slot 220 interacts with the rolling surface of the underlying wheel 207.

This interaction occurs only for a preset rotation imparted to the quarter 204 which, by virtue of the take-up which can be applied to the traction element, can thus be selected by the user.

This is done to allow the interaction of the first slot 220 with the wheel 207 only when a given angle of backward rotation of the quarter 204 is exceeded, in order to avoid accidental braking actions.

The presence of the means 211 thus allows both to compensate any wear of the wheel and to vary the extent of the tilt of the quarter before which interaction with the first slot 220 occurs.

Once the user has resumed his skating position, the first spring 222 allows the braking element to return to its initial neutral position.

FIGS. 10–15 illustrate a further embodiment for a braking device 401 in which the traction element 409 is again constituted by a cable, the first end 410 whereof is arranged to the rear of the quarter 404 and is associated with a means 411 for taking up the working length of the cable.

The means 411 for taking up the useful length of the cable is preferably constituted by a cylindrical knob 412 which can be activated by the user.

The cable is associated at an adapted sheath 413 which runs to the rear, internally or externally, with respect to the quarter 404 and to the shell 405 until it arrives below the sole 414.

The cable 409 is connected, at its second end 415, to a braking element 418 which is constituted by a pad which is preferably shaped like a parallelepiped with a rectangular base and is pivoted between the wings of the frame 406 at a first pivot 419 which is located in the interspace between two mutually adjacent wheels 407.

The braking element 418 also has a third end 424 which can oscillate freely and is arranged adjacent to the sole 414 of the shell 405. A slot is formed at the end, and a second pivot 425 is arranged within it; the second end 415 of the cable 409 is anchored to said second pivot.

An elastically deformable element, such as a spring 422, is also connected to the second pivot 425. The elastic element is rigidly coupled, at its other end, at a third pivot 426 which is arranged transversely to the lateral wings 406 or is associated below the sole 414 of the shell 405.

A forward tilting of the quarter 404 is thus followed by traction applied to the cable 409, which makes the braking element 418 rotate with respect to the first pivot 419, so as to interact at the rolling surface of the wheel 407 arranged below the heel region.

Once the tilting ends, the spring 422 returns the braking element 418 to its neutral condition.

A backward flexing of the quarter is instead followed by release of the cable 409 and by the rotation of the braking element 418 toward the toe of the skate by means of the spring 422.

In this manner, a surface of the braking element interacts with the rolling surface of the adjacent wheel 407.

Figure 11:
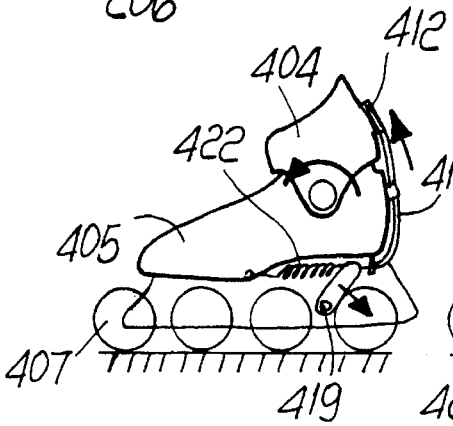
FIG. 11 is a schematic side view of the skate of FIG. 10 showing the braking device when activated by a forward tilting of the shoe.
Figure 12:
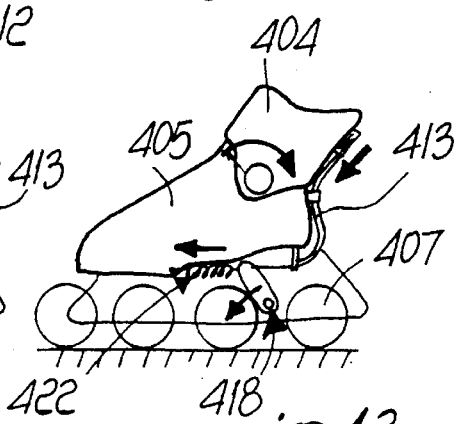
FIG. 12 is a view similar to the previous one showing the braking device when activated by a rearward tilting of the shoe.
Figure 10:
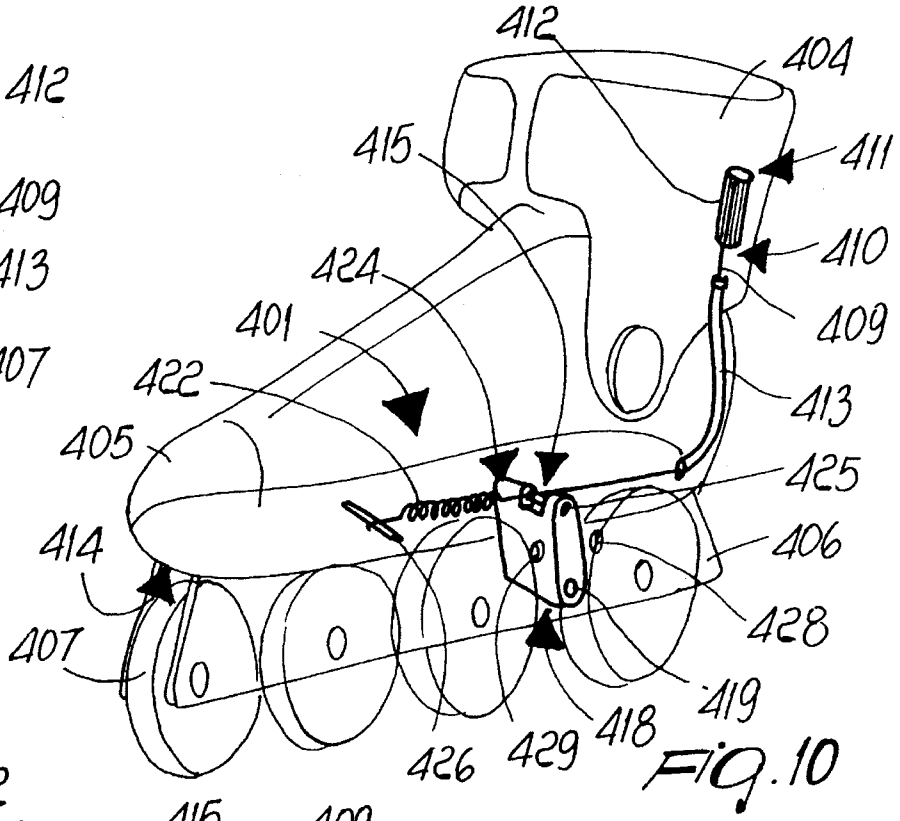
FIG. 10 is a front perspective view of a skate having a braking device according to a fifth aspect of the invention.
Figure 13:
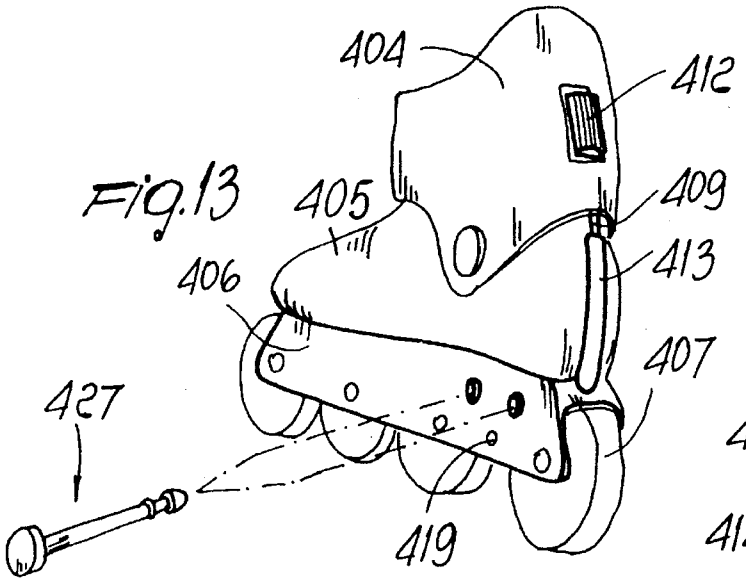
FIG. 13 is a rear perspective and partially exploded view of the skate of FIGS. 10–12.

These conditions are shown in FIGS. 11 and 12.

FIG. 12 also shows a further advantage which can be obtained by the braking device: when the skate is not being worn, the spring 422 in fact forces interaction between the braking element 418 and the wheel which is adjacent thereto in the direction of the toe of the skate: this allows the user to put the skate on in an optimum maimer even while resting the skate on the ground, because the interaction of the braking element with the wheel prevents the skate from moving.

The braking device also comprises means for selecting the activation of the braking element 418 upon a forward or backward flexing of the quarter 404.

This means is constituted by a pivot 427 which can be removably inserted at a first pair of holes 428 and at a second pair of holes 429 formed on the wings of the frame 406 in the interspace between two adjacent wheels 407 in which the braking element 418 is located and at a higher level than the first pivot 419.

The location of said first and second pairs of holes is such as, once the pivot 427 has been inserted in one of said pairs, to limit the rotation of the braking element 418 following a given tilt.

Figure 14:
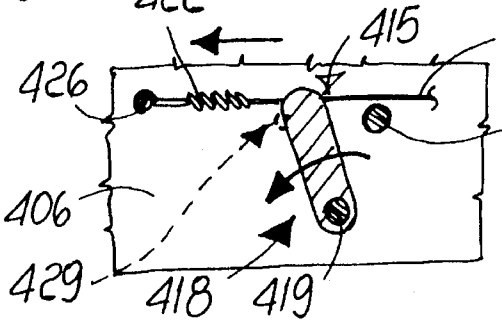
FIG. 14 is a partially sectioned detail view of the braking device of FIG. 10–13, when activated by a forward tilting.

Thus, FIG. 14 illustrates the case in which the pivot 427 is inserted within the first pair of holes 428, which is adjacent to the wheel 407 which lies below the heel region.

A forward tilt of the quarter is always followed by the rotation of the braking element 418 toward the heel of the skate, but the presence of the pivot 427 prevents interaction with the rolling surface of said wheel and thus the braking action does not occur.

Figure 15:
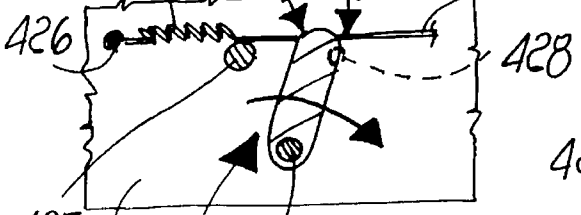
FIG. 15 is a view identical to the previous one showing the braking device when activated by a rearward tilting.

Vice versa, FIG. 15 illustrates the condition in which the pivot 427 is inserted at the second pair of holes 429, so that a backward tilt of the quarter is followed by a rotation of the braking element 418 toward the toe of the skate. This rotation, however, is limited by the presence of the pivot 427, which prevents its interaction with the wheel.

Therefore, this solution, too, allows to achieve the intended aim and objects, with the additional advantage of allowing to achieve a braking action for both forward and backward flexing of the quarter.

Furthermore, the presence of the spring 422 allows the user to put the skate on in an optimum manner, since the skate is braked.

Naturally, the materials and the dimensions which constitute the individual components of the braking device may be the most pertinent according to the specific requirements.

We claim:

1. A skate comprising:

a longitudinally-extending frame adapted to support a plurality of wheels;

a quarter mounted above said frame for forward and rearward pivotal movement relative to said frame about a first axis;

a braking element pivotally connected to the frame for pivotal movement relative to the frame about a second axis towards and away from a braking surface; and a flexible traction element connecting said quarter to said braking element, at least a portion of said flexible traction element being guided on said skate such that said portion passes on the forward side of said first axis such that backward rotation of said quarter creates a traction force in said flexible traction element and causes pivoting of said braking element about said second axis towards said braking surface.

2. The skate of claim 1, wherein said braking element is constituted by a block which interacts with the ground, said block being connected to said traction element.

3. The skate of claim 1, including an elastically deformable element arranged to cause said braking element to pivot about said second axis away from said braking surface.

4. The skate of claim 1, wherein said traction element is constituted by a cable, a first portion whereof surrounds said quarter externally and to the rear and is associated therewith at an adapted engagement means comprising a rack or a toothed region arranged longitudinally and to the rear of said quarter.

5. The skate of claim 4, wherein said cable passes inside said skate through an adapted pair of holes formed laterally with respect to said quarter, a first pair of stop elements for a pair of sheaths for guiding said cable being associated inside said quarter, said pair of sheaths protruding below the sole of said shell and being locked, by means of a second pair of stop elements, inside wings of said frame.

6. The skate of claim 5, wherein said braking element is articulated, by means of a pivot, to said frame above the locking region of said pair of sheaths.

7. The skate of claim 6, wherein said cable has a second portion which protrudes from said pair of sheaths and passes within an adapted seat formed transversely to said block, a pair of springs being interposed coaxially to said cable between said seat and said second pair of stop elements.

8. The skate of claim 1, wherein said traction element comprises a sheath locked, at one end, at a second pair of stop elements associated at lateral wings of said frame, said traction element having a second portion which protrudes from said sheath and passes within an adapted seat formed transversely to a block, which is interposed between two mutually adjacent of said wheels in the interspace between said wings of said frame and is transversely pivoted to said wings by means of a pivot.

9. The skate of claim 1, wherein said traction element is constituted by a cable, said cable being slidingly associated with an adapted sheath which runs from adjacent the rear of said quarter the terminal end of said cable being provided with a stop element which is accommodated at an adapted second seat formed at said braking element which is pivoted transversely, by means of a pivot, between the wings of said frame in a region which lies above the space between two of said wheels which are mutually adjacent.

10. The skate of claim 1, wherein said traction element is guided within an adapted sheath which interacts with a pair of stop elements which are laterally associated at the wings of said frame, said traction element having a second portion which is rigidly associated with an adapted seat formed transversely to at least one lever which has an end freely pivoted, by means of a pivot, to said wings of said frame below said sole, a braking pad being associated with the other end and interacts directly with the facing hub of one of said wheels.

11. The skate of claim 10, wherein said seat is formed in the interspace between said pivot and said braking pad, so that traction imparted to said at least one traction element is followed by direct interaction of said braking paid with said hub.

12. The skate of claim 1, wherein said traction element is constituted by a cable, a first end of said cable being arranged to the rear of said quarter and being associated with means for taking up the working length of said cable.

13. The skate of claim 12, wherein said means is constituted by a cylindrical knob which is arranged longitudinally to said quarter and has a threaded axial seat for a complementarily threaded stop element which is associated with said first end of said cable so that it is taken up or released when said knob is rotated.

14. The skate of claim 1, wherein said traction element is constituted by a cable, a first end of said cable being arranged to the rear of said quarter and being associated with means for taking up the working length of said cable, said cable being slidingly associated with an adapted sheath which runs from adjacent the rear of said quarter, a second end of said cable having a stop element which is accommodated at an adapted first seat formed at a braking element which is pivoted transversely, by means of a pivot, between the wings of said frame in a region which lies above the space between two of said mutually adjacent wheels.

15. The skate of claim 14, wherein said braking element has, in a transverse cross-section, an arc-like shape with concavities directed toward said wheels, said first seat being formed on a plane of arrangement which is higher than that of said pivot and in a more rearward position, so that traction applied by said cable is matched by an approach of an adapted first slot, formed to the rear on said braking element, toward the rolling surface of one of said wheels.

16. The skate of claim 15, wherein said braking element is kept in neutral position, and thus so that said first slot does not interact with one of said wheels, by an adapted first spring, said braking element being activated when said quarter is tilted forward beyond a given angle which can be selected through said means for taking up the working length of said traction element.

17. The skate of claim 13, wherein a second end of said traction element is connected to a braking element which is constituted by a pad, shaped like a parallelepiped with a rectangular base, which is pivoted between said wings of said frame at a first pivot arranged in the interspace between two mutually adjacent wheels.

18. The skate of claim 17, wherein said braking element has a third end which can oscillate freely and is arranged adjacent to the sole of said shell, a slot being formed at said third end, a second pivot being located at said slot, said second end of said cable being anchored to said second pivot.

19. The skate of claim 18, wherein an elastically deformable element is connected to said second pivot, said element being constituted by a spring.

20. The skate of claim 19, wherein the surfaces of said braking element, which oscillates with respect to said first pivot upon a forward or backward flexing of said quarter, interact, beyond a given rotation angle, with the rolling surfaces of said mutually adjacent wheels.

21. The skate of claim 20, wherein when the skate is not being worn said elastically deformable element forces said braking element to rotate toward the toe of said skate so as to interact with the rolling surface of said adjacent wheel.

22. The skate of claim 21 including means for selecting the activation of said braking element upon either a forward or backward flexing of said quarter.

23. The skate of claim 22, wherein said means are constituted by a pivot which can be inserted in a removable manner either within a first pair or a second pair of holes which are formed on said wings of said frame in the interspace between two adjacent wheels, in which said braking element is located, and at a higher level than said first pivot.

24. The skate of claim 23, wherein said first and second pairs of holes allow, once said pivot has been inserted in at least one of said pairs, to limit the rotation of said braking element, preventing its interaction with at least one of said wheels.

* * * * *